US008336997B2

(12) United States Patent
Katada

(10) Patent No.: US 8,336,997 B2
(45) Date of Patent: Dec. 25, 2012

(54) DROPLET EJECTION DEVICE

(75) Inventor: Masahito Katada, Ashigarakami-gun (JP); Yuko Katada, legal representative, Ebina (JP); Natsuki Katada, legal representative, Ebina (JP); Daichi Katada, legal representative, Ebina (JP)

(73) Assignee: FUJIFILM Corporation, Tokyo (JP)

( * ) Notice: Subject to any disclaimer, the term of this patent is extended or adjusted under 35 U.S.C. 154(b) by 268 days.

(21) Appl. No.: 12/719,026

(22) Filed: Mar. 8, 2010

(65) Prior Publication Data

US 2010/0245495 A1 Sep. 30, 2010

(30) Foreign Application Priority Data

Mar. 25, 2009 (JP) ..... 2009-074920

(51) Int. Cl.
*B41J 2/175* (2006.01)

(52) U.S. Cl. ..... 347/85; 347/68; 347/89

(58) Field of Classification Search ..... 347/14, 347/17–19, 54–57, 66, 67, 89, 85, 22, 92, 347/32, 6

See application file for complete search history.

(56) References Cited

U.S. PATENT DOCUMENTS

| | | | | |
|---|---|---|---|---|
| 7,841,706 | B2 * | 11/2010 | Ishinaga et al. | 347/84 |
| 2008/0283019 | A1 * | 11/2008 | Arakawa et al. | 123/196 R |
| 2010/0110155 | A1 * | 5/2010 | Delueg | 347/93 |
| 2010/0177147 | A1 * | 7/2010 | Kusunoki et al. | 347/70 |

FOREIGN PATENT DOCUMENTS

| | | | |
|---|---|---|---|
| JP | 2008-513245T | A | 5/2008 |
| JP | 2008183837 | A * | 8/2008 |

* cited by examiner

*Primary Examiner* — Ellen Kim
(74) *Attorney, Agent, or Firm* — SOLARIS Intellectual Property Group, PLLC

(57) ABSTRACT

A droplet ejection device includes a liquid ejection head, a supply flow path, a supply pump, and a supply flow path pressurizer. The supply flow path supplies the liquid to the head and for which a first depressurization threshold is specified in advance. The supply pump sucks the liquid, pressurizes the sucked liquid and supplies the sucked liquid to the head via the supply flow path, and keeps a pressure of liquid in the supply flow path near to a predetermined supply flow path target pressure. The supply flow path pressurizer pressurizes the pressure of liquid in the supply flow path if the pressure of liquid in the supply flow path falls to less than or equal to the first depressurization threshold.

24 Claims, 11 Drawing Sheets

DROPLET EJECTION DEVICE

CROSS-REFERENCE TO RELATED APPLICATION

This application claims priority under 35 USC 119 from Japanese Patent Application No. 2009-074920 filed on Mar. 25, 2009, the disclosure of which is incorporated by reference herein.

BACKGROUND OF THE INVENTION

1. Field of the Invention

The present invention relates to a droplet ejection device that ejects a liquid.

2. Description of the Related Art

An inkjet recording device is known (for example, see Japanese Patent Application Laid-Open (JP-A) No. 2008-513245) that includes a head provided with ejection apertures that eject a liquid for image recording (for example, ink), and records an image by ejecting droplets from the ejection apertures at a recording medium (for example, paper, a transparent substrate or the like).

This type of inkjet recording device, by supplying liquid stored in a storage tank to the head via supply piping with a supply pump and draining liquid in the head to the storage tank with a drainage pump, circulates the liquid between the storage tank, the supply piping, the head, and drainage piping. In this state, the liquid is ejected from the head so as to record an image represented by inputted image information on the recording medium. Pressures of the liquid inside each of the supply piping and the drainage piping are detected, and driving of each of the supply pump and the drainage pump is controlled such that pressure values of the liquid inside the supply piping and the drainage piping are at predetermined pressure values.

However, in the inkjet recording device described above, in response to a sudden pressure change of the liquid in the head when ejection of liquid by the head begins or when ejection ends or the like, undershooting or overshooting occurs before a pressure value of the liquid in the head converges to a predetermined pressure value. As a result, meniscuses at the ejection apertures are broken, and problems with ejection of the liquid may occur.

SUMMARY OF THE INVENTION

In consideration of the matter described above, the present invention will provide a droplet ejection device capable of suppressing occurrences of liquid ejection failures that are caused by sudden pressure changes of liquid in a head.

An aspect of the present invention is a droplet ejection device including: a head that ejects a liquid charged therein; a supply flow path that supplies the liquid to the head and for which a first depressurization threshold is specified in advance; a supply pump that sucks the liquid, pressurizes the sucked liquid and supplies the sucked liquid to the head via the supply flow path, and that keeps a pressure of liquid in the supply flow path near to a predetermined supply flow path target pressure; and a supply flow path pressurizer that pressurizes the pressure of liquid in the supply flow path if the pressure of liquid in the supply flow path falls to less than or equal to the first depressurization threshold.

According to this aspect, the pressure of the liquid in the supply flow path is pressurized when the pressure of the liquid in the supply flow path is equal to or below the first depressurization threshold that has been specified in advance for the supply flow path. Thus, occurrences of liquid ejection failures resulting from sudden pressure changes of the liquid in the head may be suppressed.

Another aspect of the present invention is a droplet ejection device including: a head that ejects a liquid charged therein; a supply flow path that supplies the liquid to the head and for which a first depressurization threshold is specified in advance; a drainage flow path that drains the liquid charged into the head and for which a second depressurization threshold is specified in advance; a supply pump that sucks the liquid, pressurizes the sucked liquid and supplies the sucked liquid to the head via the supply flow path, and that keeps a pressure of liquid in the supply flow path near to a predetermined supply flow path target pressure; a drainage pump that sucks and drains the liquid via the drainage flow path, and that keeps a pressure of liquid in the drainage flow path near to a predetermined drainage flow path target pressure; and a pressurizer that, if the pressure of liquid in at least one of the supply flow path and the drainage flow path falls to less than or equal to the depressurization threshold specified in advance for that flow path, pressurizes the pressure of liquid in the flow path in which the pressure has fallen to less than or equal to the depressurization threshold.

According to this aspect, when the pressure of the liquid in at least one flow path of the supply flow path and the drainage flow path is equal to or below the depressurization threshold value that has been specified in advance for that flow path, the pressure of the liquid in that flow path is pressurized. Thus, occurrences of liquid ejection failures resulting from sudden pressure changes of the liquid in the head may be suppressed.

BRIEF DESCRIPTION OF THE DRAWINGS

Exemplary embodiments of the present invention will be described in detail based on the following figures, wherein.

DETAILED DESCRIPTION OF THE INVENTION

—First Exemplary Embodiment—

Figure 1:
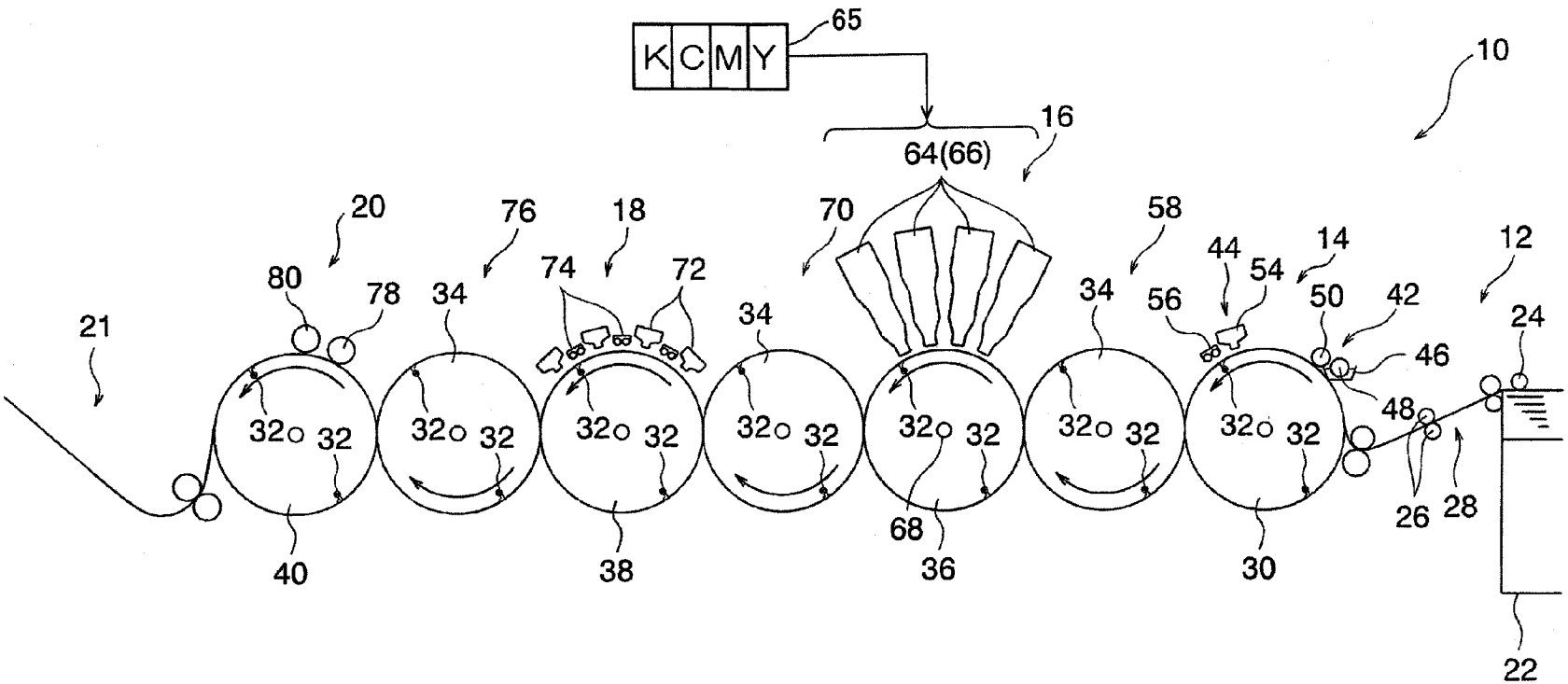
FIG. 1 is a sectional view illustrating overall structure of an inkjet recording device relating to exemplary embodiments.

FIG. 1 shows an overall view of an inkjet recording device illustrating exemplary embodiments of the droplet ejection device. As illustrated in FIG. 1, an inkjet recording device 10 is provided with a paper supply conveyance section 12 that supplies and conveys sheet paper (hereinafter referred to as paper) P which serves as a recording medium, at an upstream side of a conveyance direction of the paper P. Along the conveyance direction of the paper P to the downstream side from the paper supply conveyance section 12, an application section 14, a recording section 16, an ink drying section 18, a fixing section 20 and an ejection section 21 are provided. The application section 14 applies a processing liquid to an image recording face of the paper P (hereinafter referred to as the recording face). The recording section 16 records an image on the recording face of the paper P. The ink drying section 18 dries the image recorded on the recording face. The image fixing section 20 fixes the dried image to the paper P. The ejection section 21 ejects the paper P to which the image has been fixed.

The paper supply conveyance section 12 is provided with a stacking section 22, at which the paper P is stacked. A paper supply section 24 that supplies the paper stacked in the stacking section 22, one sheet at a time, is provided above the stacking section 22. A conveyance section 28, which is structured to include plural pairs of rollers 26, is provided at the paper P conveyance direction downstream side of the paper supply section 24 (hereinafter, the term "paper P conveyance direction" may be omitted). The paper P supplied by the paper supply section 24 passes through the conveyance section 28 structured with the plural pairs of rollers 26, and is conveyed to the application section 14.

At the application section 14, an application drum 30 is rotatably provided. A retention member 32 is provided at the application drum 30. The retention member 32 nips a leading end portion of the paper P and retains the paper P. In the state in which the paper P is retained at the surface of the application drum 30 by means of the retention member 32, the application drum 30 conveys the paper downstream by rotation of the application drum 30.

Similarly to the application drum 30, retention members 32 are also provided at an intermediate conveyance drum 34, a recording drum 36, an ink drying drum 38 and a fixing drum 40, which are described below. The paper P is passed along from upstream drums to downstream drums by means of these retention members 32.

At an upper portion of the application drum 30, an application device 42 and a drying device 44 are disposed along the circumferential direction of the application drum 30. The processing liquid is applied to the recording face of the paper P by the application device 42, and the processing liquid is dried by the drying device 44.

The processing liquid has the effect of reacting with the ink and aggregating a colorant (pigment), and promoting separation of the colorant from a solvent. A reservoir section 46, which stores the processing liquid, is provided at the application device 42, and a portion of a gravure roller 48 is immersed in the processing liquid.

A rubber roller 50 is disposed to press against the gravure roller 48. The rubber roller 50 touches against the recording face of the paper P and applies the processing liquid thereto. A squeegee (not shown) also touches against the gravure roller 48 and controls processing liquid application amounts that are applied to the recording face of the paper P.

Ideally, a processing liquid layer thickness is significantly smaller than droplets to be ejected from the head. For example, if droplet amounts are 2 picoliters, the average diameter of droplets ejected from the head is 15.6 μm. If the processing liquid film thickness is too thick, the ink dots will float in the processing liquid and not make contact with the recording face of the paper. To obtain impact dot diameters of 30 μm or above from 2 pl droplet amounts, it is preferable for the processing liquid layer thickness to be not more than 3 μm.

At the drying device 44, a hot air nozzle 54 and an infrared heater 56 (hereinafter referred to as the IR heater 56) are disposed close to the surface of the application drum 30. A solvent such as water or the like in the processing liquid is evaporated by the hot air nozzle 54 and IR heater 56, and a solid or thin-film processing liquid layer is formed at the recording face of the paper P. The processing liquid is formed into a thin layer by the processing liquid drying process. Hence, at the recording section 16, the impacting dots come into contact with the surface of the paper P and provide a required dot diameter, and it is easy to obtain the action of reacting with the thin film of processing liquid, coagulating the colorant and fixing to the surface of the paper P.

Hence, the paper P at which the processing liquid has been applied to and dried at the recording face by the application section 14 is conveyed to an intermediate conveyance section 58 that is provided between the application section 14 and the recording section 16.

At the intermediate conveyance section 58, the intermediate conveyance drum 34 is rotatably provided, the paper P is retained at the surface of the intermediate conveyance drum 34 by means of the retention member 32 that is provided at the intermediate conveyance drum 34, and the paper P is conveyed downstream by rotation of the intermediate conveyance drum 34.

At the recording section 16, the recording drum 36 is rotatably provided, the paper is retained at the surface of the recording drum 36 by means of the retention member 32 that is provided at the recording drum 36, and the paper P is conveyed downstream by rotation of the recording drum 36.

At an upper portion of the recording drum 36, head units 66 are disposed close to the surface of the recording drum 36. The head units 66 are structured with single pass-system inkjet line heads 64 (hereinafter referred to simply as "heads"). In these head units 66, heads 64 at least for the basic colors YMCK are arrayed along the circumferential direction of the recording drum 36. Images of the respective colors are recorded on the processing liquid layer that has been formed at the recording face of the paper P by the application section 14.

The processing liquid provides an effect of aggregating colorant (pigment) and latex particles dispersed in the ink with the processing liquid, to form aggregates with which colorant running on the paper P or the like does not occur. As an example of a reaction between the ink and the processing liquid, a mechanism of disrupting pigment dispersion and causing aggregation by including acid in the processing liquid and lowering pH is used, and thus exudation of colorants, color-mixing between inks of the respective colors, dot interference due to liquid-mixing when the ink droplets impact, and the like are avoided.

By performing ejections synchronously with an encoder (not shown) that detects rotation speeds, which is provided at the recording drum 36, each head 64 may set impact positions with high accuracy. In addition, the head 64 may reduce ejection irregularities regardless of vibrations of the recording drum 36, precision of a rotation axle 68, and drum surface speeds.

The head units 66 are movable away from the upper portion of the recording drum 36. Maintenance operations, such as nozzle face cleaning of the heads 64, removal of viscous ink and the like are implemented by moving the head units 66 away from the upper portion of the recording drum 36.

The inkjet recording device 10 is provided with an ink storage/charging section 65 in which inks to be provided to the respective YMCK heads 64 are stored. The ink storage/charging section 65 includes ink tanks that store inks of the colors corresponding to the respective YMCK heads 64, and the respective tanks are in fluid communication with the YMCK heads 64 via predetermined piping.

The paper P on whose recording face the image has been recorded at the recording section 16 is conveyed by rotation of the recording drum 36 to an intermediate conveyance section 70 that is provided between the recording section 16 and the ink drying section 18. The intermediate conveyance section 70 has structure substantially the same as the intermediate conveyance section 58, so will not be described.

The ink drying drum 38 is rotatably provided at the ink drying section 18. At an upper portion of the ink drying drum 38, hot air nozzles 72 and infrared heaters 74 are plurally disposed close to a surface of the ink drying section 18.

Here, as an example, the hot air nozzles 72 are disposed at an upstream side and at a downstream side, and the individual IR heaters 74 are alternatively arrayed in rows parallel with the hot air nozzles 72. Instead of this, the IR heaters 74 may be numerously disposed to the upstream and heat energy greatly irradiated at the upstream side to raise a temperature of moisture, while the hot air nozzles 72 may be numerously disposed to the downstream so as to blow away saturated water vapor.

In this case, the hot air nozzles 72 are disposed to be inclined with an angle of blowing of hot wind toward a trailing end of the paper P. Thus, the flow of hot wind from the hot air nozzles 72 may be concentrated in one direction. Moreover, the paper P may be pushed against the ink drying drum 38 and the state of retention of the paper P at the surface of the ink drying drum 38 may be maintained.

Solvent on the paper P that has been separated by the colorant aggregation action at a region at which the image has been recorded is dried by the hot wind from the hot air nozzles 72 and the IR heaters 74, and a thin image layer is formed.

While it varies in accordance with the conveyance speed of the paper P, the hot air is usually set to 50° C. to 70° C. An ink surface temperature is set to be at 50° C. to 60° C. by setting a temperature of the IR heaters 74 to 200° C. to 600° C. The evaporated solvent is evacuated out of the inkjet recording device 10 together with air, and the air is ejected. This air may be cooled by a refrigeration device/radiator or the like and ejected as a liquid.

The paper P at whose recording face the image has been dried is conveyed by rotation of the ink drying drum 38 to an intermediate conveyance section 76 that is provided between the ink drying section 18 and the fixing section 20. The intermediate conveyance section 76 has structure substantially the same as the intermediate conveyance section 58, so will not be described.

The image fixing drum 40 is rotatably provided in the fixing section 20. In the fixing section 20, the latex particles in the thin image layer that was formed on the ink drying drum 38 are heated and pressured, and fused, and the fixing section 20 has the function of solid-fixing onto the paper P.

At an upper portion of the image fixing drum 40, a heating roller 78 is disposed close to the surface of the image fixing drum 40. At this heating roller 78, a halogen lamp is incorporated inside a metal pipe with good thermal conductivity, of aluminium or the like. Heat energy for at least the glass transition temperature Tg of the latex is supplied by the heating roller 78. As a result, the latex particles fuse, and are pressed into irregularities on the paper and fixed. Further, irregularities in the recording face may be leveled and glossiness provided.

A fixing roller 80 is provided downstream of the heating roller 78. The fixing roller 80 is disposed in a state of abutting against the surface of the image fixing drum 40, so as to provide nipping force between the fixing roller 80 and the image fixing drum 40. Accordingly, at least one of the fixing roller 80 and the image fixing drum 40 has a resilient layer at the surface thereof and is structured to have a uniform nipping width with regard to the paper P.

The paper P to whose recording face the image has been fixed by the processes described above is conveyed to the ejection section 21 provided downstream of the fixing section 20, by rotation of the image fixing drum 40.

The exemplary embodiment has been described as including the fixing section 20. However, it would be sufficient for the image formed on the recording face to be dried and fixed by the ink drying section 18. Thus, a structure that is not provided with the fixing section 20 is also possible.

Figure 2:
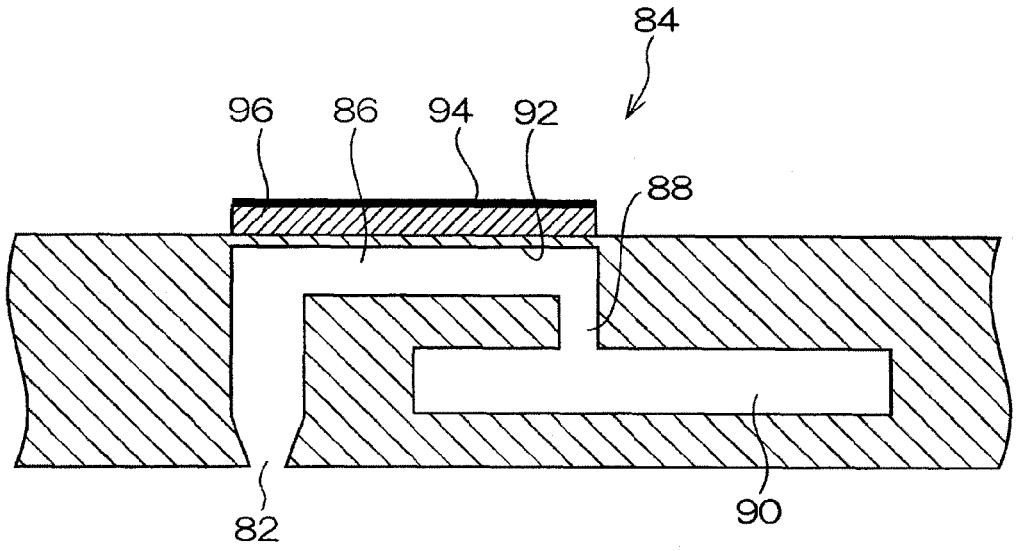
FIG. 2 is a sectional view illustrating three-dimensional structure of a droplet ejection element that is provided at each of nozzles of a head relating to the exemplary embodiments.

FIG. 2 shows a sectional diagram illustrating three-dimensional structure of a droplet ejection element 84 (an ink chamber unit corresponding with a single nozzle 82) that is provided at each nozzle of the head 64. As shown in FIG. 2, each of pressure chambers 86 is in fluid communication with a common flow path 90 via a supply aperture 88. The common flow path 90 is in fluid communication with the ink storage/charging section 65 that acts as an ink supply source, and ink supplied from the ink storage/charging section 65 is distributed and supplied to the pressure chambers 86 via the common flow path 90.

An actuator 96, which is provided with an individual electrode 94, is joined to a pressure plate 92 (an oscillation plate that is also used as a common electrode) that constitutes a portion of a surface of the pressure chamber 86 (of a ceiling surface in FIG. 2). By application of a driving voltage between the individual electrode 94 and the common electrode, the actuator 96 is deformed and the volume of the pressure chamber 86 changes. In association therewith, ink is ejected from the nozzle 82 by a pressure change. For the actuator 96, a piezoelectric element that employs a piezoelectric body of lead zirconate titanate, barium titanate or the like can be used. When the displacement of the actuator 96 returns to its original state after the ink ejection, new ink is recharged into the pressure chamber 86 through the supply aperture 88 from the common flow path 90.

Thus, in the inkjet recording device 10, ink drops may be ejected from the nozzles 82 by controlling driving of the actuators 96 corresponding to the nozzles 82 in accordance with dot position data that is generated from image data. Further, in the inkjet recording device 10, while the paper P is being conveyed in a sub scanning direction at a certain speed, a desired image may be recorded on the paper P by controlling ink ejection timings of the nozzles 82 corresponding to the conveyance speed.

Now, in the exemplary embodiments, a system in which ink droplets are caused to fly out by deformation of the actuator 96 as represented by a piezo element (piezoelectric element) is employed. However, systems for ejecting ink are not particularly limited in exemplary embodiments. Various systems may be employed instead of a piezojet system, such as a thermal jet system, which heats ink with a heat-generating body such as a heater or the like, generates air bubbles and causes droplets to fly out by pressure thereof, or the like.

Figure 3:
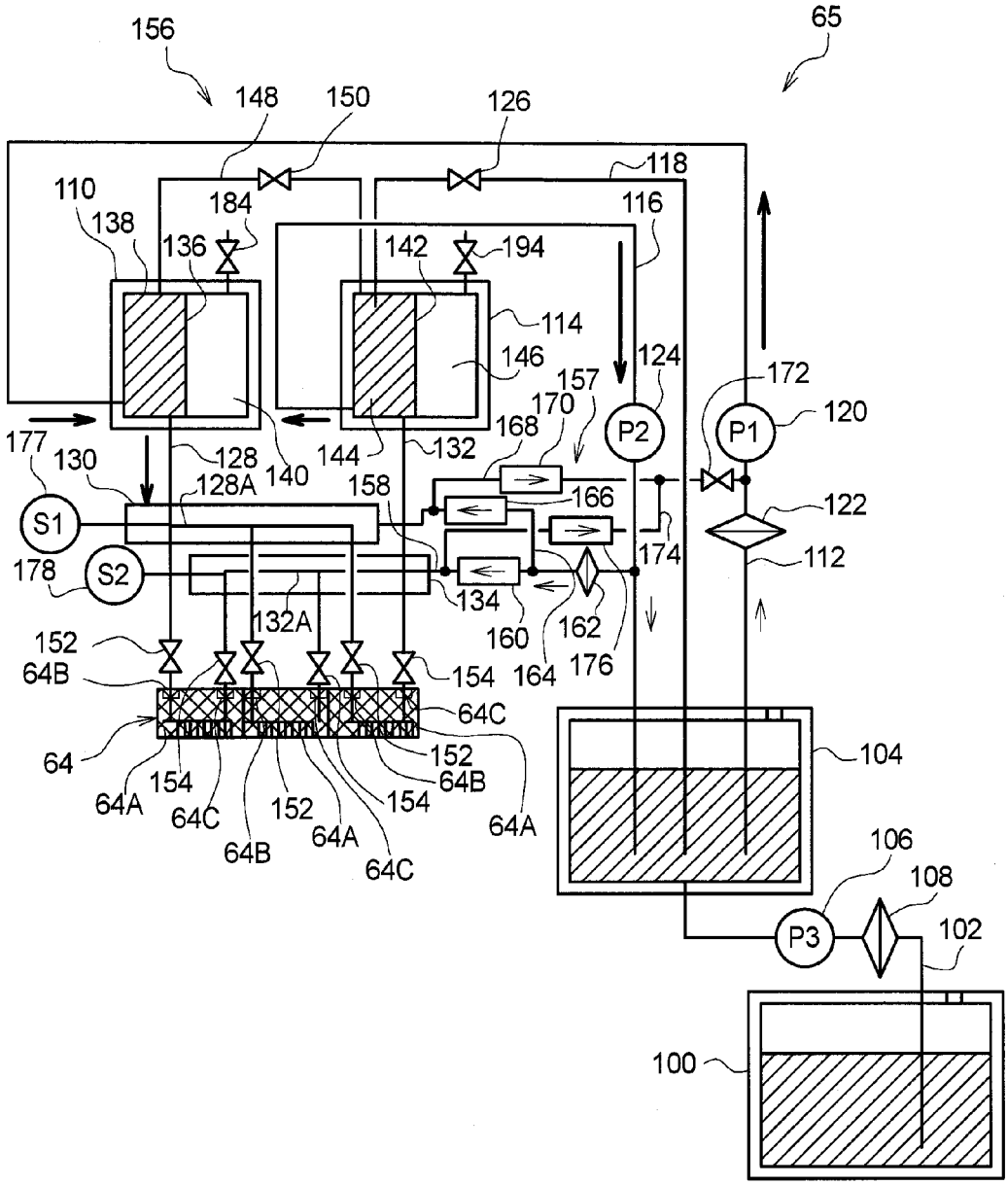
FIG. 3 is a structural diagram illustrating structure of a head and an ink storage/charging section relating to a first exemplary embodiment.

Detailed structure of the ink storage/charging section 65 relating to the first exemplary embodiment will be described. FIG. 3 shows a structural diagram illustrating structure of the head 64 and the ink storage/charging section 65 relating to the first exemplary embodiment. As shown in FIG. 3, the ink storage/charging section 65 is provided in correspondence with each of the YMCK heads 64. Because the ink storage/charging sections 65 have the same structure, a single ink storage/charging section 65 will be representatively described here.

An ink tank 100 is in fluid communication with a buffer tank 104 via piping 102. The ink tank 100 and the buffer tank 104 are both opened to the atmosphere. A buffer pump 106 and a filter 108 are provided on the piping 102. Ink stored in the ink tank 100 is supplied to the buffer tank 104 by the buffer pump 106 being driven. A predetermined amount of ink is stored in the buffer tank 104 by ink supply from the ink tank 100.

The buffer tank 104 is in fluid communication with a supply tank 110 via piping 112. The buffer tank 104 is also in fluid communication with a recovery tank 114 via piping 116. The buffer tank 104 is yet further in fluid communication with the recovery tank 114 via piping 118. A supply pump 120, which performs feeding between the supply tank 110 and the buffer tank 104, is provided on the piping 112. A filter 122 is provided on the piping 112 between the supply pump 120 and the buffer tank 104. A second (drainage) pump 124, which performs feeding between the recovery tank 114 and the buffer tank 104, is provided on the piping 116. A liquid chamber electromagnetic valve 126, which opens and closes the piping 118, is provided on the piping 118.

The supply tank 110 is in fluid communication with the head 64 via piping 128 and a manifold 130. The recovery tank 114 is in fluid communication with the head 64 via piping 132 and a manifold 134.

The interior of the supply tank 110 is divided into a liquid chamber 138 and an air chamber 140 by a resilient membrane 136. The interior of the recovery tank 114 is divided into a liquid chamber 144 and an air chamber 146 by a resilient membrane 142. The piping 112 and the piping 128 are in fluid communication with the liquid chamber 138 of the supply tank 110, and the piping 116 and the piping 132 are in fluid communication with the liquid chamber 144 of the recovery tank 114. The liquid chamber 138 is in fluid communication with the liquid chamber 144 via piping 148. A liquid chamber electromagnetic valve 150, which opens and closes the piping 148, is provided on the piping 148.

The head 64 is divided into plural head modules 64A (three divisions in FIG. 3), which include ejection apertures that respectively eject ink droplets. The head 64 is structured with supply apertures 64B that supply ink to the respective head modules 64A from the supply tank 110, and drainage apertures 64C for draining ink to the recovery tank 114. The piping 128 branches at the manifold 130 before the supply apertures 64B, and supplies ink to the head modules 64A through the respective supply apertures 64B. The piping 132, from each of the drainage apertures 64C, is joined at the manifold 134 before the recovery tank 114.

In the present exemplary embodiment, the head 64 is divided into the plural head modules 64A, but the head 64 may be a single body rather than being divided.

Supply electromagnetic valves 152, which respectively open and close the branched pipes 128, are provided at each of the supply apertures 64B. Drainage electromagnetic valves 154, which respectively open and close the branched piping 132, are provided on the piping 132.

A supply system flow path is constituted by the piping 112, the supply tank 110 and the piping 128, and a recovery system flow path is structured by the piping 132, the recovery tank 114 and the piping 116. An ink supply system circulation path 156 is constituted by the supply system flow path, the head 64, the recovery system flow path and the buffer tank 104.

The ink storage/charging section 65 is provided with a pressure regulation apparatus 157 that, when ink is being circulated through the circulation path 156, operates when a pressure being applied by ink inside the head 64 is to be regulated. The pressure regulation apparatus 157 is structured to include piping 158, 164, 168 and 174, differential pressure valves 160, 166, 170 and 176, and a depressurization electromagnetic valve 172.

A drainage flow path 132A is a common flow path for the branched flow paths through each of the head modules 64A, in the piping 132 in the manifold 134. The drainage flow path 132A is in fluid communication with the piping 116 between the drainage pump 124 and the buffer tank 104, via the piping 158. A drainage pressurization threshold and a drainage depressurization threshold are specified in advance for the drainage flow path 132A. In the inkjet recording device 10, a value obtained beforehand as an ink depressurization value of the drainage flow path 132A that is a necessary minimum for breakage of meniscuses (i.e., a maximum to avoid the breakage of meniscuses) at the nozzles 82 is used as the drainage depressurization threshold. This value can be obtained by experimentation with an actual model of the inkjet recording device 10, computer simulation based on design specifications of the inkjet recording device 10, or the like. As the drainage pressurization threshold, a value obtained beforehand as an ink pressure value of the drainage flow path 132A that is a necessary minimum for breakage of meniscuses (i.e., a maximum to avoid the breakage of meniscuses) at the nozzles 82 is used. This value can be also obtained by experimentation with an actual model of the inkjet recording device 10, computer simulation based on design specifications of the inkjet recording device 10, or the like.

The differential pressure valve 160 is provided on the piping 158. The differential pressure valve 160 closes off the piping 158 while a difference between ink pressure in the drainage flow path 132A and atmospheric pressure has not reached (is greater than) the drainage depressurization threshold, and opens up the piping 158 when the difference between the ink pressure in the drainage flow path 132A and atmospheric pressure is at or below the drainage depressurization threshold. A filter 162 is provided on the piping 158 between a point of communication with the piping 116 and the differential pressure valve 160.

A supply flow path 128A is a common flow path of the paths of the piping 128 in the manifold 130 that respectively branch to the head modules 64A. The supply flow path 128A is in fluid communication with the piping 158 between the differential pressure valve 160 and the filter 162, via the piping 164. A supply pressurization threshold and a supply depressurization threshold are specified beforehand for the supply flow path 128A. In the inkjet recording device 10, a value obtained beforehand as an ink depressurization value of the supply flow path 128A that is a necessary minimum for breakage of meniscuses (i.e., a maximum to avoid the breakage of meniscuses) at the nozzles 82 is used as the supply depressurization threshold. This value can be obtained by experimentation with an actual model of the inkjet recording device 10, computer simulation based on design specifications of the inkjet recording device 10, or the like. As the supply pressurization threshold, a value obtained beforehand as an ink pressure value of the supply flow path 128A that is a necessary minimum for breakage of meniscuses (i.e., a maximum to avoid the breakage of meniscuses) at the nozzles 82 is used. This value can be also obtained by experimentation with an actual model of the inkjet recording device 10, computer simulation based on design specifications of the inkjet recording device 10, or the like.

The differential pressure valve 166 is provided on the piping 164. The differential pressure valve 166 closes off the piping 164 while a difference between ink pressure in the supply flow path 128A and atmospheric pressure has not reached (is greater than) the supply depressurization threshold, and opens up the piping 164 when the difference between the ink pressure in the supply flow path 128A and atmospheric pressure is at or below the supply depressurization threshold.

The piping 164 between the differential pressure valve 166 and the supply flow path 128A is in fluid communication with the piping 112 between the supply pump 120 and the filter 122, via the piping 168. The differential pressure valve 170 is provided on the piping 168. The differential pressure valve 170 closes off the piping 168 when the difference between ink pressure in the supply flow path 128A and atmospheric pressure is below the supply pressurization threshold, and opens up the piping 168 when the difference between the ink pressure in the supply flow path 128A and atmospheric pressure is at or above the supply pressurization threshold. The depressurization electromagnetic valve 172, which is capable of opening and closing the piping 168, is also provided on the piping 168, between the point of communication with the piping 112 and the differential pressure valve 170.

The piping 158 between the differential pressure valve 160 and the drainage flow path 132A is in fluid communication with the piping 168 between the differential pressure valve 170 and the depressurization electromagnetic valve 172, via the piping 174. The differential pressure valve 176 is provided on the piping 174. The differential pressure valve 176 closes off the piping 174 when the difference between ink pressure in the drainage flow path 132A and atmospheric pressure is below the drainage pressurization threshold, and opens up the piping 174 when the difference between the ink pressure in the drainage flow path 132A and atmospheric pressure is at or above the drainage pressurization threshold.

A supply side pressure sensor 177 is connected to the supply flow path 128A. The supply side pressure sensor 177 may detect a pressure applied by ink in the supply flow path 128A. A drainage side pressure sensor 178 is connected to the drainage flow path 132A. The drainage side pressure sensor 178 may detect a pressure applied by ink in the drainage flow path 132A.

Next, the supply tank 110 and the recovery tank 114 are described.

Figure 4A:
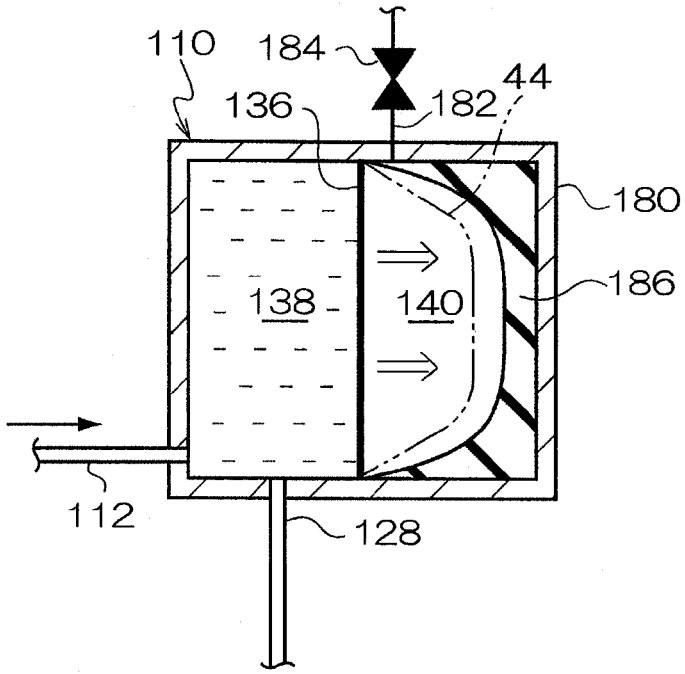
FIG. 4A is a sectional view illustrating structure of a supply tank relating to the exemplary embodiments.

As illustrated in FIG. 4A, the supply tank 110 is provided with a cylindrical casing 180. A cavity inside the casing 180 is divided into the liquid chamber 138 and the air chamber 140 by the resilient membrane 136. The resilient membrane 136 has a circular plate form, and is disposed so as to divide the cylindrically formed interior of the casing 180 at a plane substantially orthogonal to the axial direction thereof. The resilient membrane 136 is structured of a material that is capable of resiliently deforming, such as rubber, resin or the like.

Ink is stored in the liquid chamber 138 and is in communication with both the piping 112 and the piping 128. Air is charged into the air chamber 140, and the air chamber 140 is in fluid communication with open piping 182 which is opened to the atmosphere. An air chamber electromagnetic valve 184, which opens and closes the open piping 182, is provided on the open piping 182.

A resilient member 186 is provided in the casing 180 at a portion of the air chamber 140 that opposes the resilient membrane 136. The resilient member 186 is formed to receive a shape into which the liquid chamber 138 bulges to the air chamber 140 side when the liquid chamber 138 is pressurized (see the broken line in FIG. 4A). That is, the resilient member 186 is formed to structure a bowl-shaped cavity at the circular-shaped resilient membrane 136 side, with thickness thereof becoming thinner from along the inner peripheral wall of the casing 180 toward the axial center of the tube. The resilient member 186 is capable of being pressed by the resilient membrane 136 and resiliently deformed, and may be structured of a material such as rubber, resin, a porous body or the like.

Figure 4B:
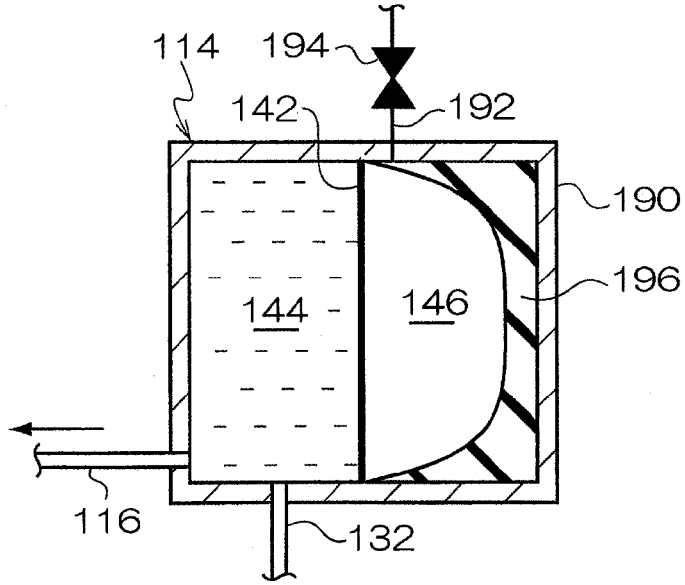
FIG. 4B is a sectional view illustrating structure of a recovery tank relating to the exemplary embodiments.

As illustrated in FIG. 4B, the recovery tank 114 has substantially the same form as the supply tank 110, with a casing 190 corresponding to the casing 180, the resilient membrane 142 corresponding to the resilient membrane 136, the liquid chamber 144 corresponding to the liquid chamber 138 and the air chamber 146 corresponding to the air chamber 140.

Ink is stored in the liquid chamber 144 and is in communication with the piping 116 and the piping 132. Air is charged into the air chamber 146, and the air chamber 146 is in fluid communication with open piping 192 which is opened to the atmosphere. An air chamber electromagnetic valve 194, which opens and closes the open piping 192, is provided on the open piping 192.

A resilient member 196 is provided in the casing 190 at a portion of the air chamber 146 that opposes the resilient membrane 142. The resilient member 196 is formed to receive a shape into which the resilient membrane 142 bulges to the air chamber 146 side when the liquid chamber 144 is pressurized. That is, the resilient member 196 is formed to structure a bowl-shaped cavity at the circular-shaped resilient membrane 142 side, with thickness thereof becoming thinner from along the inner peripheral wall of the casing 190 toward the axial center of the tube. The resilient member 196 is capable of being pressed by the resilient membrane 142 and resiliently deformed, and may be structured of a material such as rubber, resin, a porous body or the like.

Figure 5:
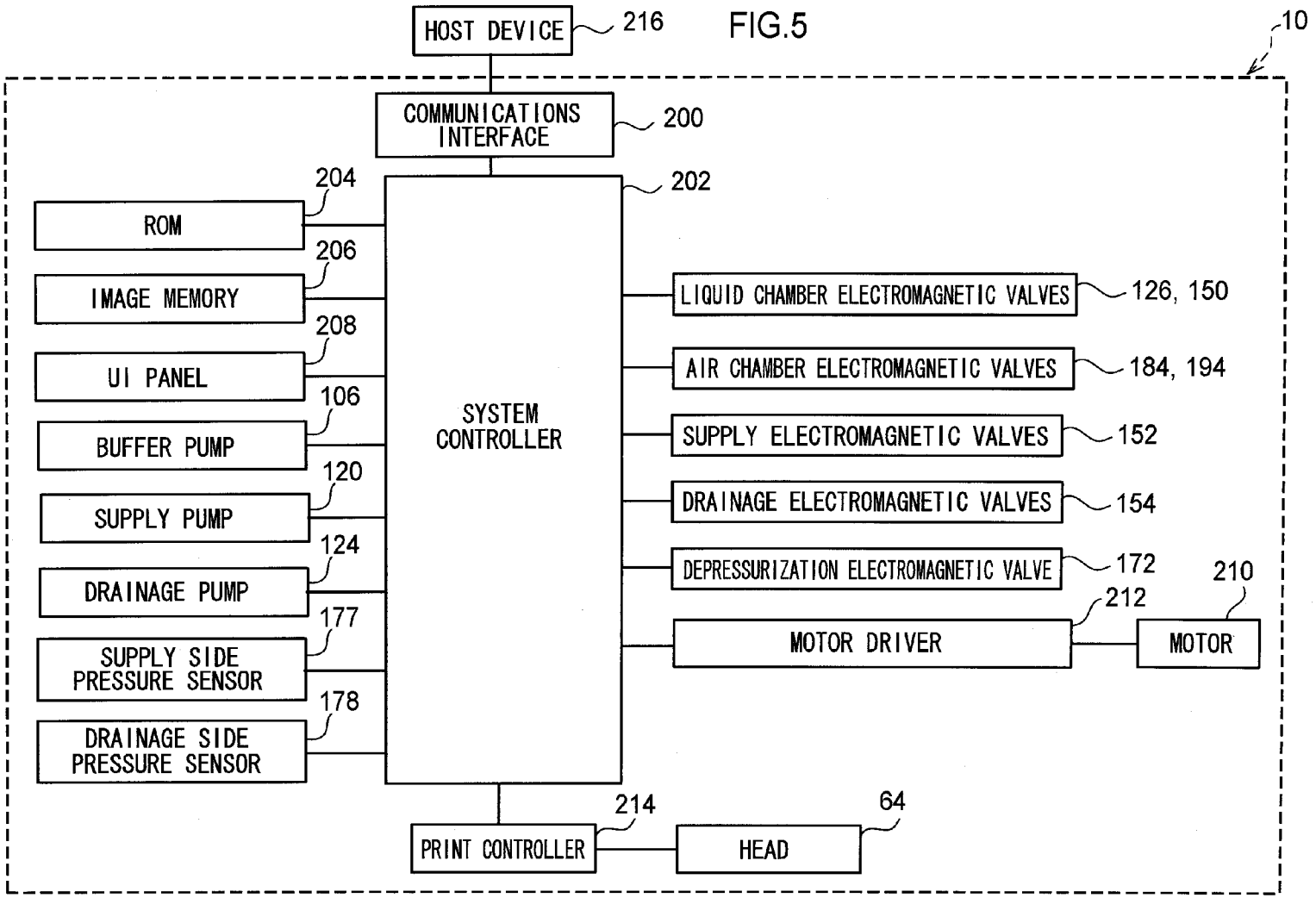
FIG. 5 is a block diagram illustrating principal structures of an electronic system of an inkjet recording device relating to the first exemplary embodiment.

FIG. 5 is a block diagram illustrating principal structures of an electronic system of the inkjet recording device 10 relating to the first exemplary embodiment. As illustrated in FIG. 5, the inkjet recording device 10 is structured to include a communications interface 200, a system controller 202, a read-only memory (ROM) 204, an image memory 206, a user interface (UI) panel 208, a motor 210, a motor driver 212 and a print controller 214.

The system controller 202 is connected to the buffer pump 106, the supply pump 120, the drainage pump 124, the supply electromagnetic valves 152, the drainage electromagnetic valves 154, the liquid chamber electromagnetic valves 126 and 150, the air chamber electromagnetic valves 184 and 194, the supply side pressure sensor 177, the drainage side pressure sensor 178, the communications interface 200, the ROM 204, the image memory 206, the UI panel 208, the motor driver 212 and the print controller 214.

The communications interface 200 is an interface with a host device 216 that is used for performing printing instructions to the inkjet recording device 10 and the like by a user.

The communications interface 200 may employ a serial interface such as Universal Serial Bus (USB), IEEE 1394, ETHERNET®, a wireless network or the like, or a parallel interface such as CENTRONICS or the like. A buffer memory (not shown) for increasing the speed of communications may be incorporated at this section.

Image data representing an image to be recorded on the paper P, which is sent from the host device 216, is received by the inkjet recording device 10 via the communications interface 200, and is temporarily memorized in the image memory 206. The image memory 206 is a memory section that memorizes image signals inputted via the communications interface 200; writing of the data is implemented through the system controller 202. The image memory 206 is not limited to memories constituted with semiconductor elements, and may employ a magnetic medium such as a hard disc.

The UI panel 208 is structured by, for example, a touch panel display, in which a transparent touch panel is laminated on a display. The UI panel 208 displays various kinds of information at a display screen of the display, and required information and instructions are inputted thereat by a user touching the touch panel.

The system controller 202 is structured by a CPU (central processing unit) and peripheral circuits and suchlike. The system controller 202 functions as a control device that controls the whole of the inkjet recording device 10 in accordance with predetermined programs, and also functions as a calculation device that performs various kinds of calculation. That is, the system controller 202: acquires respective detection results from the supply side pressure sensor 177 and the drainage side pressure sensor 178; controls respective operations of the buffer pump 106, the supply pump 120 and the drainage pump 124; controls respective opening and closing of the liquid chamber electromagnetic valves 126 and 150, the supply electromagnetic valves 152, the drainage electromagnetic valves 154, the air chamber electromagnetic valves 184 and 194, and the depressurization electromagnetic valve 172; displays various kinds of information at the UI panel 208; acquires details of operational instructions by a user from the UI panel 208; controls communications with the host device 216; controls reading and writing at the ROM 204 and the image memory 206; and the like. The system controller 202 also generates control signals that control the motor 210 of the conveyance system. In addition to control signals, the system controller 202 sends image data that has been memorized in the image memory 206 to the print controller 214.

Programs to be executed by the system controller 202 and various kinds of data required for control are stored in the ROM 204. The ROM 204 may be a non-writable memory unit. However, if the various kinds of data are to be updated as necessary, it is preferable for the ROM 204 to employ a writable memory device such as an EEPROM.

The image memory 206 is employed as a temporary memory region for image data, and is also employed as a deployment region for programs and a calculation work area for the system controller 202.

The print controller 214 functions as a signal processor that, in accordance with control by the system controller 202, performs processing for various kinds of processing, correction and the like, for generating signals for ejection control based on the image data sent from the system controller 202. The print controller 214 controls ejection driving of the heads 64 on the basis of the generated ejection data. The print controller 214 is provided one-to-one for each of the YMCK heads 64.

The motor driver 212 is a driver (driving circuit) that drives the supply pump 120 in accordance with instructions from the system controller 202.

Next, operation of the inkjet recording device 10 relating to the first exemplary embodiment will be described.

Circulation of ink in the circulation path 156 is continuously implemented as follows at times of image recording by the inkjet recording device 10.

In the circulation path 156, the ink supply side pressure is set to be higher by a predetermined amount than the ink recovery side pressure. Thus, ink is fed from the supply tank 110 through the head 64 to the recovery tank 114. If a specified standard pressure to be applied to the ink in the supply flow path 128A is Pin, a specified standard pressure to be applied to the ink in the drainage flow path 132A is Pout and a back pressure (negative pressure) at the nozzles from which the ink is ejected is Pnzl, then Pin+Hin>Pnzl>Pout+Hout ($mmH_2O$) (Hin is a pressure differential (water head pressure) generated by a height difference between the nozzle face and the supply flow path 128A, and Hout is a pressure differential (water head pressure) generated by a height difference between the nozzle face and the drainage flow path 132A), and a predetermined back pressure is applied at the nozzles. Control is performed by the supply pump 120 and the drainage pump 124, on the basis of pressure values detected by the supply side pressure sensor 177 and pressure values detected by the drainage side pressure sensor 178, such that the pressure applied by ink in the supply flow path 128A goes to Pin and the pressure applied by ink in the drainage flow path 132A goes to Pout. As a result, the ink circulates through the circulation path 156. At this time, the resilient membrane 136 is disposed at a position that is not in contact with the resilient member 186, and the resilient membrane 142 is disposed at a position that is not in contact with the resilient member 196. Meanwhile, the air chamber electromagnetic valves 184 and 194 are in their closed states, and the liquid chamber electromagnetic valves 126 and 150, the supply electromagnetic valves 152 and the drainage electromagnetic valves 154 are in their open states.

Thus, thickening of ink at the nozzles 82 is prevented by the ink being circulated, and excellent ink ejection conditions may be maintained over long periods.

Figure 6:
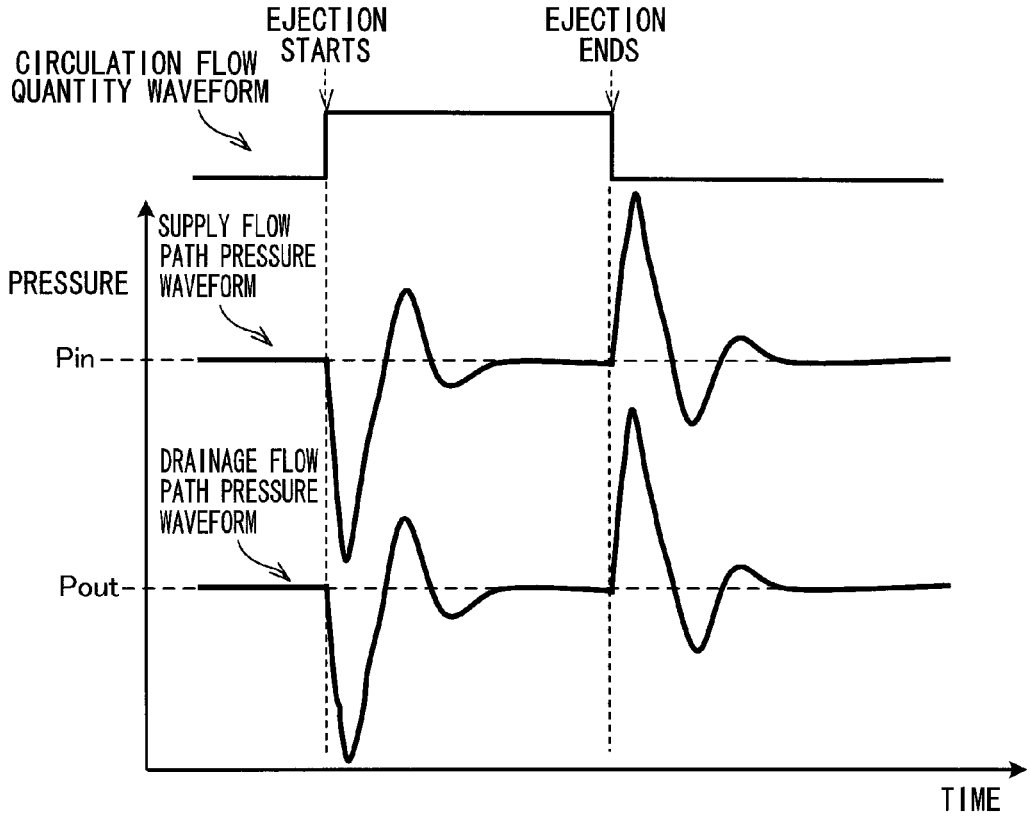
FIG.6 RELATED ART
FIG. 6 is waveform diagrams illustrating a circulation flow quantity waveform of a circulation path of a related art inkjet recording device, and pressure waveforms that are applied by ink in a supply common flow path and a drainage common flow path, respectively.

Now, in a related art inkjet recording device (the inkjet recording device 10 without the pressure regulation apparatus 157), when ink is ejected from the nozzles 82 by the head 64, as shown by the example in FIG. 6: when ejection of the ink commences, the ink in the flow paths 128A and 132A suddenly depressurizes greatly, and undershooting occurs in a period before the pressure applied by the ink in the supply flow path 128A is converged on Pin by the supply pump 120 and the drainage pump 124; and when ejection of the ink ends, the ink in the flow paths 128A and 132A suddenly pressurizes greatly, and overshooting occurs in a period before the pressure applied by the ink in the drainage flow path 132A is converged on Pout by the supply pump 120 and the drainage pump 124. As a result, there is a risk of meniscuses at the nozzles 82 breaking and ink ejection failures occurring. Problems that are caused by the meniscuses at the nozzles 82 breaking include, for example, ingression of air bubbles through the nozzles 82 due to the above-mentioned undershooting and leaking of the ink from the nozzles 82 due to the above-mentioned overshooting.

Figure 7:
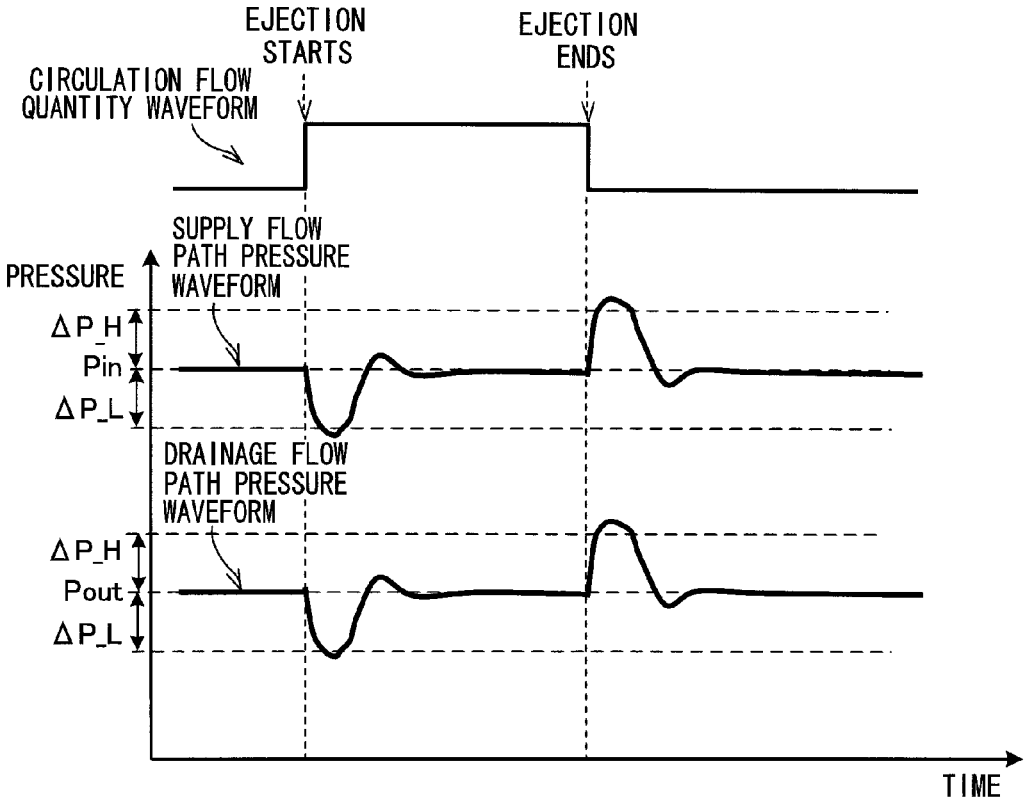
FIG. 7 is waveform diagrams illustrating a circulation flow quantity waveform of a circulation path of the inkjet recording device relating to the exemplary embodiments, and pressure waveforms that are applied by ink in a supply common flow path and a drainage common flow path, respectively.

In contrast, in the inkjet recording device 10 relating to the first exemplary embodiment, when the pressure applied by the ink in the supply flow path 128A falls to less than or equal to the supply depressurization threshold in association with the ejection of ink commencing, the differential pressure valve 166 is opened, ink drained through the drainage pump 124 is supplied to the supply flow path 128A via the piping 164, and the pressure of the ink in the supply flow path 128A is pressurized. Further, when the pressure applied by the ink in the drainage flow path 132A falls to less than or equal to the drainage depressurization threshold, the differential pressure valve 160 is opened, ink drained through the drainage pump 124 is supplied to the drainage flow path 132A via the piping 158, and the pressure of the ink in the drainage flow path 132A is pressurized. Thus, as illustrated by the example in FIG. 7, depressurization of ink in the flow paths 128A and 132A when the ejection of ink commences may be greatly ameliorated. As a result, breakage of meniscuses at the nozzles 82 due to excessive depressurization of the ink in the flow paths 128A and 132A may be prevented.

Furthermore, when the pressure applied by the ink in the supply flow path 128A rises to greater than or equal to the supply pressurization threshold in association with the end of ink ejection, the depressurization electromagnetic valve 172 and the differential pressure valve 166 are opened, the ink in the supply flow path 128A is sucked by the supply pump 120 via the piping 164 and 168, and the pressure of the ink in the supply flow path 128A is depressurized. When the pressure applied by the ink in the drainage flow path 132A rises to greater than or equal to the drainage pressurization threshold, the depressurization electromagnetic valve 172 and the differential pressure valve 176 are opened, the ink in the drainage flow path 132A is sucked by the supply pump 120 via the piping 158 and 174, and the pressure of the ink in the drainage flow path 132A is depressurized. Thus, as illustrated by the example in FIG. 7, pressurization of ink in the flow paths 128A and 132A when the ejection of ink ends may be greatly ameliorated. As a result, breakage of meniscuses at the nozzles 82 due to excessive pressurization of the ink in the flow paths 128A and 132A may be prevented.

The operation pressures of the differential pressure valves 160, 166, 170 and 176 are set in advance in accordance with the following mathematical expressions (1) to (4). In expressions (1) to (4), Pv_L_in represents the operation pressure of the differential pressure valve 166, Pv_L_out represents the operation pressure of the differential pressure valve 160, Pv_H_in represents the operation pressure of the differential pressure valve 170, Pv_H_out represents the operation pressure of the differential pressure valve 176, ΔP_L represents a margin of pressure between Pin and Pout at which the differential pressure valves 160 and 166 operate, ΔP_H represents a margin of pressure between Pin and Pout at which the differential pressure valves 170 and 176 operate, h_L_in represents a height difference of the differential pressure valve 166 measured from the supply side pressure sensor 177, h_H_in represents a height difference of the differential pressure valve 170 measured from the supply side pressure sensor 177, h_L_out represents a height difference of the differential pressure valve 160 measured from the drainage side pressure sensor 178 and h_H_out represents a height difference of the differential pressure valve 176 measured from the drainage side pressure sensor 178.

$$Pv_L_in = Pin - \Delta P_L - h_L_in \quad (1)$$

$$Pv_L_out = Pout - \Delta P_L - h_L_out \quad (2)$$

$$Pv_H_in = Pin + \Delta P_H - h_H_in \quad (3)$$

$$Pv_H_out = Pout + \Delta P_H - h_H_out \quad (4)$$

As described in detail hereabove, according to the inkjet recording device 10 relating to the first exemplary embodiment, the following are provided: the head 64 that ejects a liquid charged thereto (in this case, ink); the supply pump 120 that sucks the liquid and pressurizes the sucked liquid, and supplies the same to the head 64 via the supply flow path (in this case, the supply flow path 128A) for which the supply depressurization threshold is specified in advance, and performs control so as to keep the pressure of the liquid in the supply flow path near to a predetermined supply flow path target pressure; the drainage pump 124 that sucks and drains the liquid charged into the head 64 via the drainage flow path (in this case, the drainage flow path 132A) for which the drainage depressurization threshold is specified in advance, and performs control so as to keep the pressure of the liquid in the drainage flow path near to a predetermined drainage flow path target pressure; and a pressurizer (in this case, the drainage pump 124) that, when the pressure of the liquid in one or both of the supply flow path and the drainage flow path falls to less than or equal to the depressurization threshold specified in advance for that flow path, pressurizes the pressure of the liquid in the flow path in which the pressure has fallen below the depressurization threshold. In consequence, occurrences of ejection failures of the liquid that result from sharp changes in pressure of the liquid in the head 64 may be suppressed.

Furthermore, according to the inkjet recording device 10 relating to the first exemplary embodiment, the supply pressurization threshold for the supply flow path and the drainage pressurization threshold for the drainage flow path are respectively specified in advance, and a depressurizer (in this case, the drainage pump 124) is provided that, when the pressure of the liquid in one or both of the supply flow path and the drainage flow path rises to greater than or equal to the pressurization threshold specified in advance for that flow path, depressurizes the pressure of the liquid in the flow path in which the pressure has risen above the pressurization threshold. In consequence, occurrences of ejection failures of the liquid that result from sharp changes in pressure of the liquid in the head 64 may be suppressed.

According to the inkjet recording device 10 relating to the first exemplary embodiment, the following are also provided: depressurization communication flow paths (in this case, the piping 168 and 174) that communicate between the liquid supply side of the supply pump 120 and the supply flow path and drainage flow path; and depressurization regulation valves (in this case, the differential pressure valves 170 and 176) that are provided on the depressurization communication flow paths such that, when the pressure of the liquid in a flow path that is in fluid communication with a depressurization communication flow path is less than the pressurization threshold specified beforehand for that flow path, the depressurization communication flow path is closed such that suction force of the supply pump 120 will not be propagated into that flow path in which the liquid pressure is below the pressurization threshold and, when the pressure of the liquid in a flow path that is in fluid communication with a depressurization communication flow path is at or above the pressurization threshold specified beforehand for that flow path, the depressurization communication flow path is opened such that suction force of the supply pump 120 will be propagated into the flow path in which the liquid pressure is at or above the pressurization threshold. In consequence, with a simple structure, liquid in a flow path in which the pressure is greater than or equal to a pressurization threshold may be effectively depressurized, and responsiveness of the supply pump 120 may be improved.

According to the inkjet recording device 10 relating to the first exemplary embodiment, the depressurization regulation valves are structured by the differential pressure valves 170 and 176 that, when the difference between the pressure of liquid in a flow path in fluid communication with a depressurization communication flow path and atmospheric pressure is less than the pressurization threshold specified beforehand for that flow path, close the depressurization communication flow path such that suction force of the supply pump 120 is not propagated into the flow path in which the difference between the liquid pressure and atmospheric pressure is below the pressurization threshold and that, when the difference between the pressure of liquid in a flow path in fluid communication with a depressurization communication flow path and atmospheric pressure is at or above the pressurization threshold specified beforehand for that flow path, open the depressurization communication flow path such that suction force of the supply pump 120 is propagated into the flow path in which the difference between the liquid pressure and atmospheric pressure is at or above the pressurization threshold. In consequence, with a simple structure, the suction force of the supply pump 120 may, as necessary, be propagated to the liquid in flow paths in which the pressure is greater than or equal to the pressurization threshold.

According to the inkjet recording device 10 relating to the first exemplary embodiment, when the pressure of liquid in one or both flow paths of the supply flow path and the drainage flow path falls to less than or equal to the depressurization threshold specified beforehand for that flow path, the drainage pump 124 is configured to function as the pressurizer, using drainage force to pressurize the pressure of liquid in the flow path in which the pressure has fallen below the depressurization threshold. In consequence, occurrences of ejection failures of the liquid that are caused by sharp changes in pressure of the liquid in the head 64 when ejection of the liquid commences may be suppressed with a simple structure.

Further, according to the inkjet recording device 10 relating to the first exemplary embodiment, the following are provided: pressurization communication flow paths (in this case, the piping 158 and 164) that communicate between the liquid drainage side of the drainage pump 124 and the supply flow path and drainage flow path; and pressurization regulation valves (in this case, the differential pressure valves 160 and 166) that are provided on the pressurization communication flow paths such that, when the pressure of the liquid in a flow path that is in fluid communication with a pressurization communication flow path has not reached the depressurization threshold specified beforehand for that flow path, the pressurization communication flow path is closed such that drainage force of the drainage pump 124 will not be propagated into that flow path in which the liquid pressure has not reached the depressurization threshold and, when the pressure of the liquid in a flow path that is in fluid communication with a pressurization communication flow path is at or below the depressurization threshold specified beforehand for that flow path, the pressurization communication flow path is opened such that drainage force of the drainage pump 124 will be propagated into the flow path in which the liquid pressure is at or below the depressurization threshold. In consequence, with a simple structure, liquid in a flow path in which the pressure is less than or equal to a depressurization threshold may be effectively pressurized, and responsiveness of the drainage pump 124 may be improved.

According to the inkjet recording device 10 relating to the first exemplary embodiment, the pressurization regulation valves are structured by the differential pressure valves 160 and 166 that, when the difference between the pressure of liquid in a flow path in fluid communication with a pressurization communication flow path and atmospheric pressure has not reached the depressurization threshold specified beforehand for that flow path, close the pressurization communication flow path such that drainage force of the drainage pump 124 is not propagated into the flow path in which the difference between the liquid pressure and atmospheric pressure has not reached the depressurization threshold and that, when the difference between the pressure of liquid in a flow path in fluid communication with a pressurization communication flow path and atmospheric pressure is at or below the depressurization threshold specified beforehand for that flow path, open the pressurization communication flow path such that drainage force of the drainage pump 124 is propagated into the flow path in which the difference between the liquid pressure and atmospheric pressure is at or below the depressurization threshold. In consequence, with a simple structure, the drainage force of the drainage pump 124 may, as necessary, be propagated to the liquid in flow paths in which the pressure is less than or equal to the depressurization threshold.

-Second Exemplary Embodiment-

In the first exemplary embodiment, an example has been described of a case in which excess pressure on ink in the flow paths 128A and 132A is ameliorated using the differential pressure valves 160, 166, 170 and 176. In this second exemplary embodiment, a case is described in which excess pressure on ink in the flow paths 128A and 132A is ameliorated using electromagnetic valves. Here, in this second exemplary embodiment, the same reference numerals are assigned to members that are the same as in the inkjet recording device 10 relating to the first exemplary embodiment and will not be described; only portions that differ from the first exemplary embodiment are described.

Figure 8:
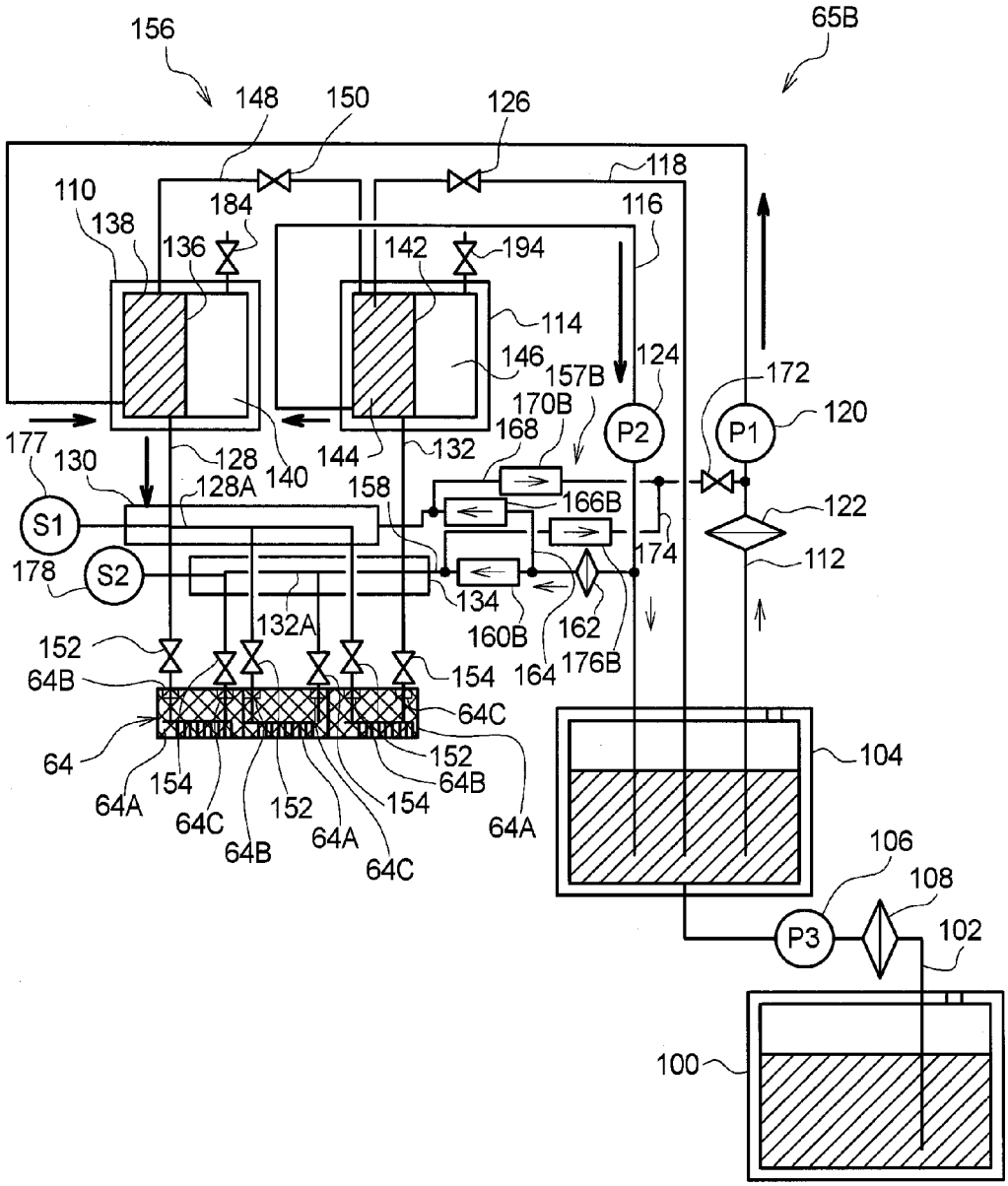
FIG. 8 is a structural diagram illustrating structure of a head and an ink storage/charging section relating to a second exemplary embodiment.

FIG. 8 shows a structural diagram illustrating structure of the head 64 and an ink storage/charging section 65B relating to the second exemplary embodiment.

As shown in FIG. 8, an inkjet recording device 10B differs from the inkjet recording device 10 relating to the first exemplary embodiment in that the ink storage/charging section 65B is employed instead of the ink storage/charging section 65.

The ink storage/charging section 65B differs from the ink storage/charging section 65 in that: a pressure regulation apparatus 157B is employed instead of the pressure regulation apparatus 157, a drainage side pressurization electromagnetic valve 160B is employed instead of the differential pressure valve 160, a supply side pressurization electromagnetic valve 166B is employed instead of the differential pressure valve 166, a supply side depressurization electromagnetic valve 170B is employed instead of the differential pressure valve 170 and a drainage side depressurization electromagnetic valve 176B is employed instead of the differential pressure valve 176.

Figure 9:
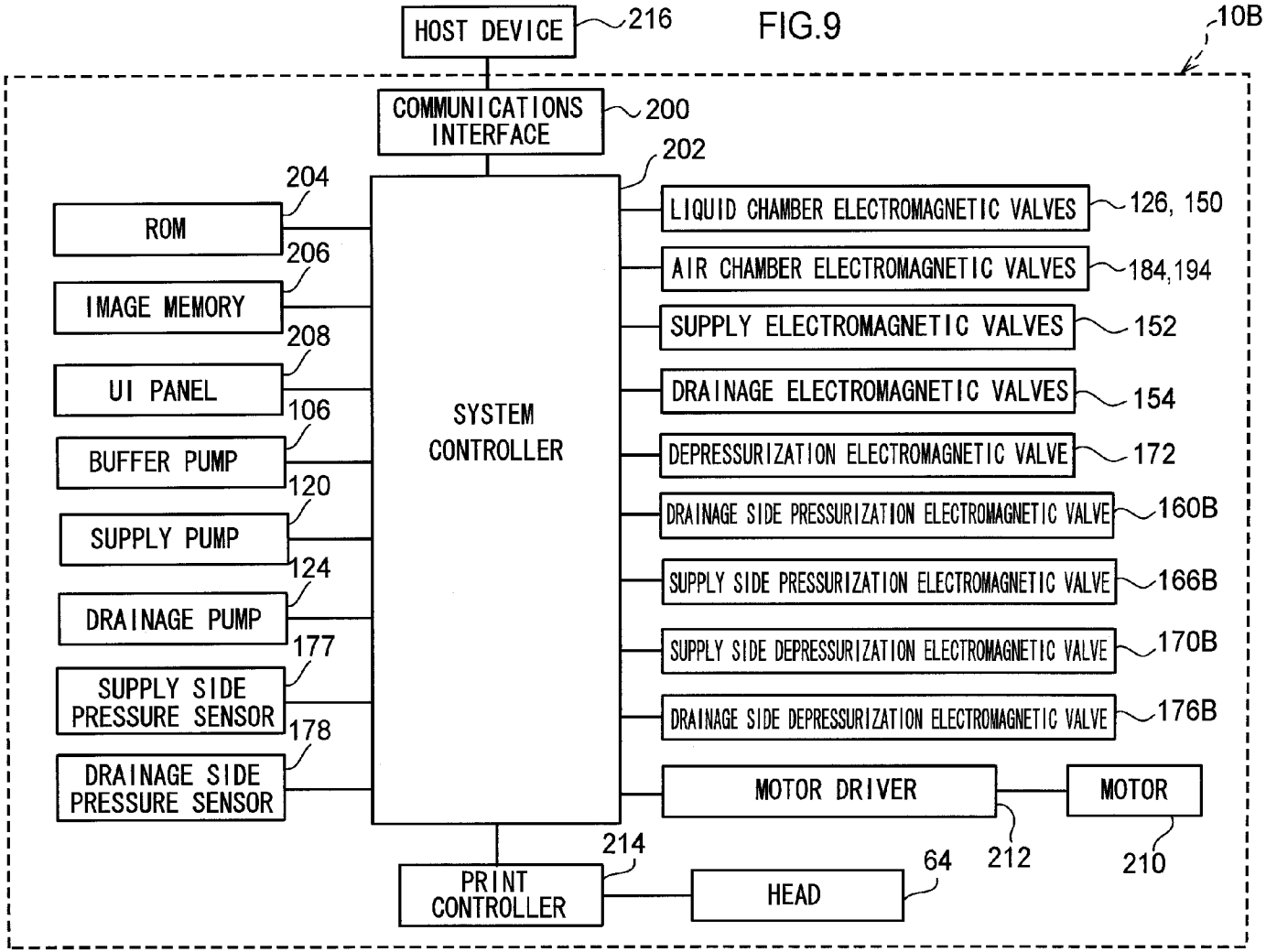
FIG. 9 is a block diagram illustrating principal structures of an electronic system of an inkjet recording device relating to the second exemplary embodiment.

FIG. 9 is a block diagram illustrating principal structures of an electronic system of the inkjet recording device 10B relating to the second exemplary embodiment.

As illustrated in FIG. 9, the system controller 202 is connected to the drainage side pressurization electromagnetic valve 160B, the supply side pressurization electromagnetic valve 166B, the supply side depressurization electromagnetic valve 170B and the drainage side depressurization electromagnetic valve 176B. Hence, the system controller 202 may perform respective opening and closing control of the drainage side pressurization electromagnetic valve 160B, the supply side pressurization electromagnetic valve 166B, the supply side depressurization electromagnetic valve 170B and the drainage side depressurization electromagnetic valve 176B.

In the inkjet recording device 10B, when the ink circulates through the circulation path 156, supply side pressure regulation processing, which regulates pressure applied by ink in the supply flow path 128A, and drainage side pressure regulation processing, which regulates pressure applied by ink in the drainage flow path 132A, are executed in parallel.

Figure 10:
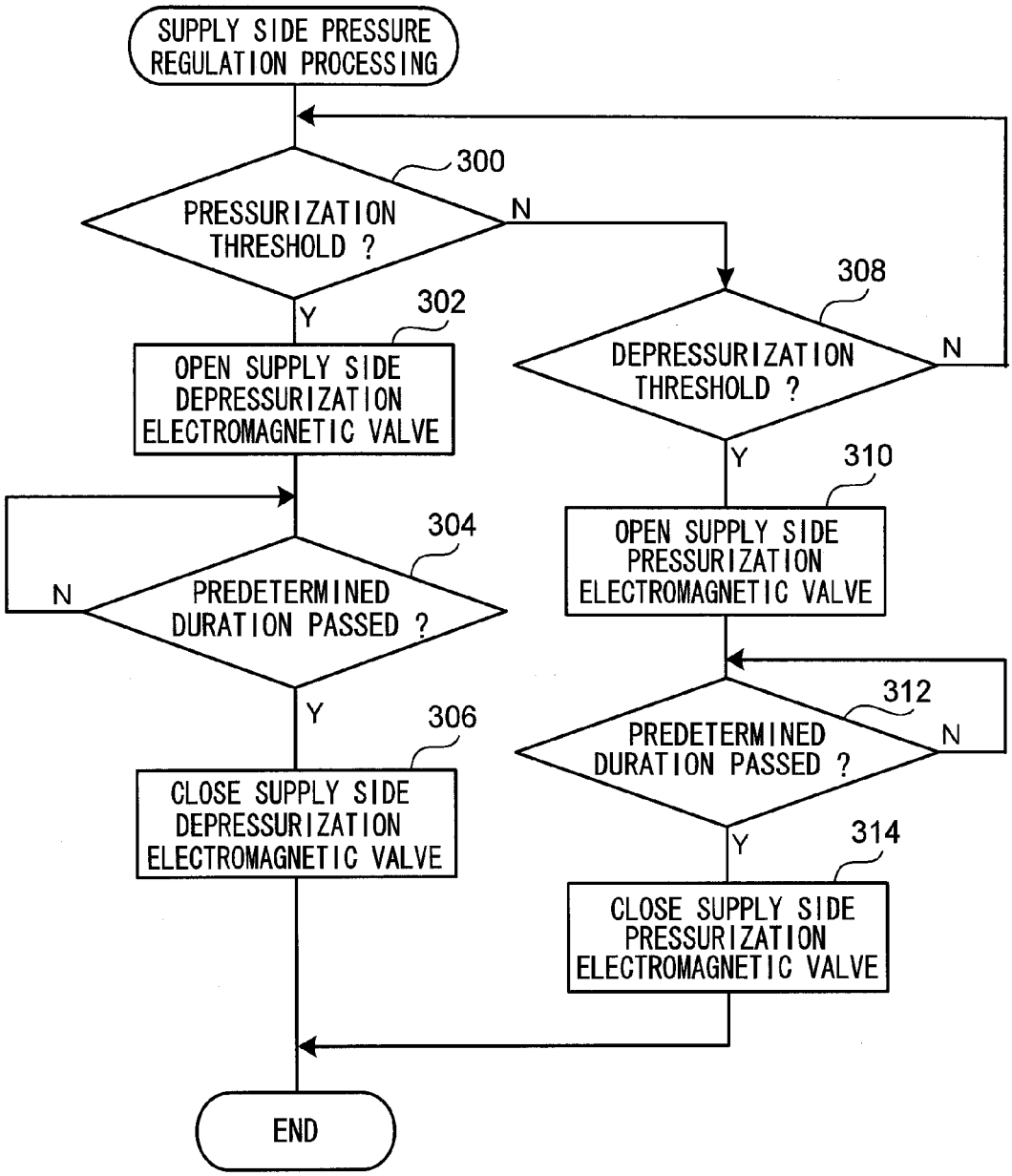
FIG. 10 is a flowchart illustrating the flow of a supply side pressure regulation program relating to the second exemplary embodiment.

Next, operation of the inkjet recording device 10B when the above-mentioned supply side pressure regulation processing is executed is described with reference to FIG. 10. FIG. 10 is a flowchart illustrating the flow of a supply side pressure regulation program that is executed by the system controller 202 when the pressure applied by the ink in the supply flow path 128A has come to Pin. This program is stored in advance in a predetermined region of the ROM 204.

In step 300 of FIG. 10, it is determined whether or not the pressure of the ink in the supply flow path 128A has risen to greater than or equal to the supply pressurization threshold. If this determination is positive, control passes to step 302, the supply side depressurization electromagnetic valve 170B and the depressurization electromagnetic valve 172 are opened, and then control passes to step 304.

In step 304, the processing waits until a predetermined duration has passed from the end of the processing of step 302 (at least a duration until the pressure of the ink in the supply flow path 128A is at a pressure at which meniscuses of the nozzles 82 will not break). Then control passes to step 306 and the supply side depressurization electromagnetic valve 170B and the depressurization electromagnetic valve 172 are closed, after which the supply side pressure regulation program ends.

On the other hand, if the determination of step 300 is negative, control passes to step 308, and it is determined whether or not the pressure of the ink in the supply flow path 128A has fallen to less than or equal to the supply depressurization threshold. If this determination is negative, control returns to step 300. However, if this determination is positive, control passes to step 310.

In step 310, the supply side pressurization electromagnetic valve 166B is opened, control passes to step 312, and the processing waits until a predetermined duration has passed from the end of the processing of step 310 (at least a duration until the pressure of the ink in the supply flow path 128A is at a pressure at which meniscuses of the nozzles 82 will not break). Then control passes to step 314 and the supply side pressurization electromagnetic valve 166B is closed, after which the supply side pressure regulation program ends.

Figure 11:
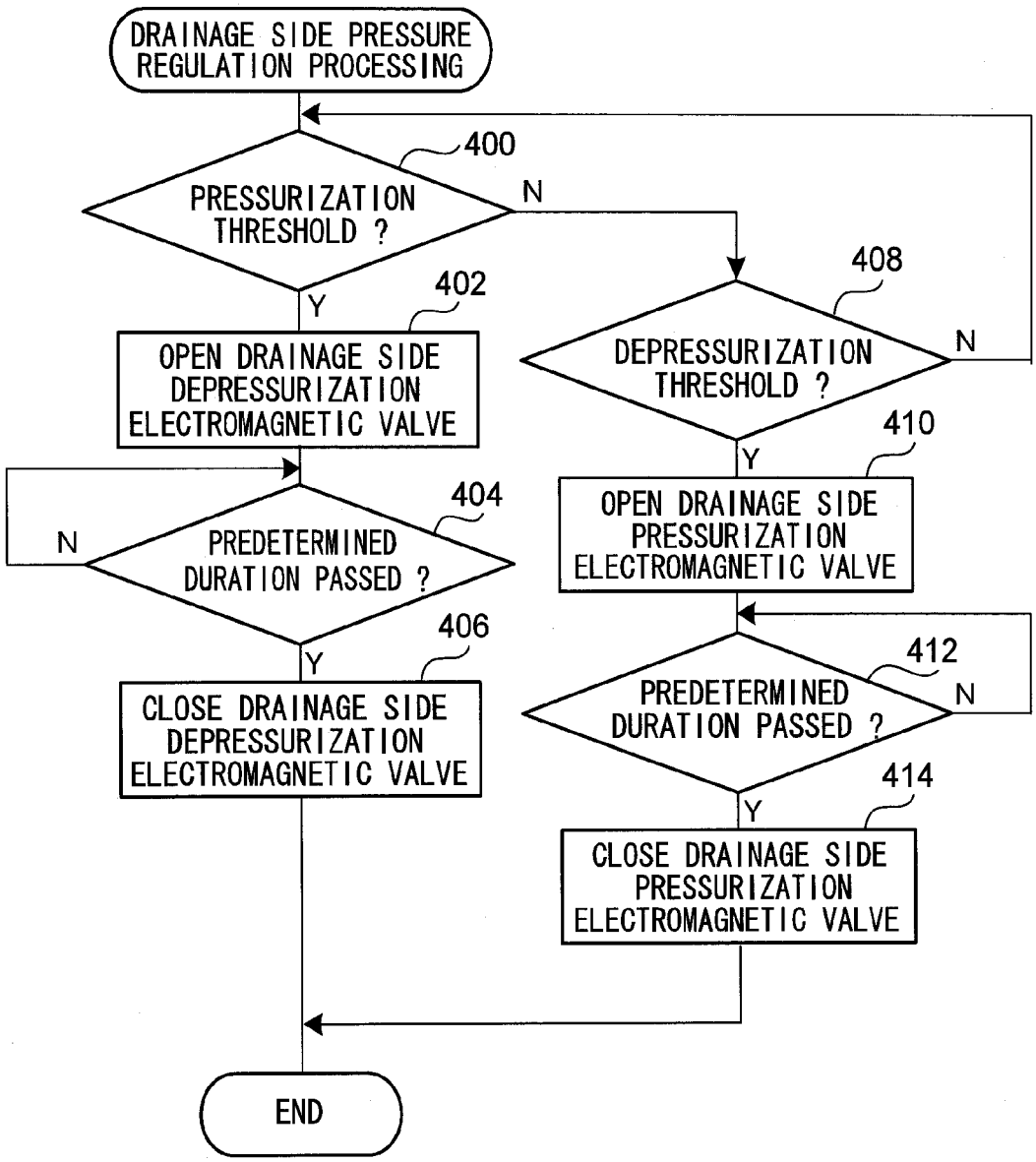
FIG. 11 is a flowchart illustrating the flow of a drainage side pressure regulation program relating to the second exemplary embodiment.

Next, operation of the inkjet recording device 10B when the above-mentioned drainage side pressure regulation processing is executed is described with reference to FIG. 11. FIG. 11 is a flowchart illustrating a flow of a drainage side pressure regulation program that is executed by the system controller 202 when the pressure applied by the ink in the drainage flow path 132A has come to Pout. This program is stored in advance in a predetermined region of the ROM 204.

In step 400 of FIG. 11, it is determined whether or not the pressure of the ink in the drainage flow path 132A has risen to greater than or equal to the drainage pressurization threshold. If this determination is positive, control passes to step 402, the drainage side depressurization electromagnetic valve 176B and the depressurization electromagnetic valve 172 are opened, and then control passes to step 404.

In step 404, the processing waits until a predetermined duration has passed from the end of the processing of step 402 (at least a duration until the pressure of the ink in the drainage flow path 132A is at a pressure at which meniscuses of the nozzles 82 will not break). Then control passes to step 406 and the drainage side depressurization electromagnetic valve 176B and the depressurization electromagnetic valve 172 are closed, after which the drainage side pressure regulation program ends.

On the other hand, if the determination of step 400 is negative, control passes to step 408, and it is determined whether or not the pressure of the ink in the drainage flow path 132A has fallen below the drainage depressurization threshold. If this determination is negative, control returns to step 400. However, if this determination is positive, control passes to step 410.

In step 410, the drainage side pressurization electromagnetic valve 160B is opened, control passes to step 412, and the processing waits until a predetermined duration has passed from the end of the processing of step 410 (at least a duration until the pressure of the ink in the drainage flow path 132A is at a pressure at which meniscuses of the nozzles 82 will not break). Then control passes to step 414 and the drainage side pressurization electromagnetic valve 160B is closed, after which the drainage side pressure regulation program ends.

Thus, by the supply side pressure regulation processing and drainage side pressure regulation processing being executed by the inkjet recording device 10B, when the pressure of ink in the flow path 128A or 132A falls to or below the depressurization threshold, the ink in the flow path 128A or 132A is pressurized and when the pressure of ink in the flow path 128A or 132A rises to or above the pressurization threshold, the ink in the flow path 128A or 132A is depressurized. In consequence, the same effects as in the inkjet recording device 10 of the first exemplary embodiment may be obtained with the inkjet recording device 10B.

In the exemplary embodiments described above, examples have been described of cases of performing pressurization and depressurization of ink in the respective flow paths of the flow paths 128A and 132A, but the present invention is not to be limited thus. One or both of pressurization and depressurization may be performed on ink in one or both of the flow paths 128A and 132A. In such a case too, rapid pressure changes of ink in the head 64 may be ameliorated, and thus occurrences of liquid ejection failures resulting from sharp changes in pressure of the liquid in the head 64 may be suppressed.

In the exemplary embodiments described above, examples have been described of cases of using drainage force of the drainage pump 124 to pressurize ink in the flow paths 128A and 132A and using suction force of the supply pump 120 to depressurize ink in the flow paths 128A and 132A, but the present invention is not to be limited thus. One or more of pressurization of ink in the supply flow path 128A, depressurization of ink in the supply flow path 128A, pressurization of ink in the supply flow path 132A and depressurization of ink in the supply flow path 132A may be performed with (a) dedicated pump(s). For example, a variant example may be mentioned in which the ink in the supply flow path 128A is pressurized with a dedicated pump to be used only for pressurization of the ink in the supply flow path 128A (a supply flow path side pressurizer), the ink in the drainage flow path 132A is pressurized with a dedicated pump to be used only for pressurization of the ink in the drainage flow path 132A (a drainage flow path side pressurizer), the ink in the supply flow path 128A is depressurized with a dedicated pump to be used only for depressurization of the ink in the supply flow path 128A (a supply flow path side depressurizer), and the ink in the drainage flow path 132A is depressurized with a dedicated pump to be used only for depressurization of the ink in the drainage flow path 132A (a drainage flow path side depressurizer).

In the above exemplary embodiments, depressurization and pressurization of ink in the flow paths 128A and 132A are performed using suction force and drainage force or the like of pumps, but the present invention is not to be limited thus. For example, the respective flow paths of the flow paths 128A and 132A may be structured with deformable pipe members, to which piezoelectric elements are joined and which deforms when pressures of at least a predetermined value are applied from the piezoelectric elements. Depressurization and/or pressurization of ink in the flow paths may be performed by deforming these pipe members (piezoelectric elements). Thus, modes that perform pressurization and depressurization of the ink in the flow paths 128A and 132A may be suitably altered.

In the above exemplary embodiments, the respective tank interiors of the supply tank 110 and the recovery tank 114 are divided into liquid chambers and air chambers. However, the operations and effects of the embodiments may be obtained without providing the air chambers.

According to the droplet ejection device of the embodiments, occurrences of liquid ejection failures due to sudden pressure changes of liquid in a head may be suppressed.

What is claimed is:

1. A droplet ejection device comprising:

a head that ejects a liquid charged therein;

a supply flow path that supplies the liquid to the head and for which a first depressurization threshold is specified in advance;

a supply pump that sucks the liquid, pressurizes the sucked liquid and supplies the sucked liquid to the head via the supply flow path, and that keeps a pressure of liquid in the supply flow path near to a predetermined supply flow path target pressure; and a supply flow path pressurizer that pressurizes the pressure of liquid in the supply flow path if the pressure of liquid in the supply flow path falls to less than or equal to the first depressurization threshold.

2. The droplet ejection device according to claim 1, further comprising a supply flow path depressurizer that depressurizes the pressure of liquid in the supply flow path if the pressure of liquid in the supply flow path rises to greater than or equal to a first pressurization threshold which is specified in advance for the supply flow path.

3. The droplet ejection device according to claim 1, wherein the pressure of liquid in the supply flow path is depressurized using suction force of the supply pump if the pressure of liquid in the supply flow path rises to greater than or equal to a first pressurization threshold which is specified in advance for the supply flow path.

4. The droplet ejection device according to claim 3, further comprising:

a supply side depressurization communication flow path that is in fluid communication with a liquid suction side of the supply pump and the supply flow path; and a supply side depressurization regulation valve that is provided on the supply side depressurization communication flow path such that the supply side depressurization communication flow path is closed when the pressure of liquid in the supply flow path is less than the first pressurization threshold and the supply side depressurization communication flow path is opened when the pressure of liquid in the supply flow path is greater than or equal to the first pressurization threshold.

5. The droplet ejection device according to claim 4, wherein the supply side depressurization regulation valve comprises a differential pressure valve that closes the supply side depressurization communication flow path when a difference between the pressure of liquid in the supply flow path and atmospheric pressure is less than the first pressurization threshold, and opens the supply side depressurization communication flow path when the difference between the pressure of liquid in the supply flow path and atmospheric pressure is greater than or equal to the first pressurization threshold.

6. The droplet ejection device according to claim 1, further comprising a drainage flow path that drains the liquid charged into the head, wherein the supply flow path pressurizer comprises a drainage pump that sucks and drains the liquid via the drainage flow path, and pressurizes the pressure of liquid in the supply flow path using drainage force if the pressure of liquid in the supply flow path falls to less than or equal to the first depressurization threshold.

7. The droplet ejection device according to claim 1, further comprising:

a drainage flow path that drains the liquid charged into the head and for which a second depressurization threshold is specified in advance;

a drainage pump that sucks and drains the liquid via the drainage flow path; and a drainage flow path pressurizer that pressurizes a pressure of liquid in the drainage flow path if the pressure of liquid in the drainage flow path falls to less than or equal to the second depressurization threshold.

8. The droplet ejection device according to claim 6, wherein a second depressurization threshold is specified in advance for the drainage flow path, and the drainage pump pressurizes a pressure of liquid in the drainage flow path using drainage force if the pressure of liquid in the drainage flow path falls to less than or equal to the second depressurization threshold.

9. The droplet ejection device according to claim 8, further comprising:

a drainage side pressurization communication flow path that is in fluid communication with a liquid drainage side of the drainage pump and the drainage flow path; and a drainage side pressurization regulation valve that is provided on the drainage side pressurization communication flow path such that the drainage side pressurization communication flow path is closed when the pressure of liquid in the drainage flow path is greater than the second depressurization threshold and the drainage side pressurization communication flow path is opened when the pressure of liquid in the drainage flow path is less than or equal to the second depressurization threshold.

10. The droplet ejection device according to claim 9, wherein the drainage side pressurization regulation valve comprises a differential pressure valve that closes the drainage side pressurization communication flow path when a difference between the pressure of liquid in the drainage flow path and atmospheric pressure is greater than the second depressurization threshold, and opens the drainage side pressurization communication flow path when the difference between the pressure of liquid in the drainage flow path and atmospheric pressure is less than or equal to the second depressurization threshold.

11. The droplet ejection device according to claim 6, further comprising:

a supply side pressurization communication flow path that is in fluid communication with a liquid drainage side of the drainage pump and the supply flow path; and a supply side pressurization regulation valve that is provided on the supply side pressurization communication flow path such that the supply side pressurization communication flow path is closed when the pressure of liquid in the supply flow path is greater than the first depressurization threshold and the supply side pressurization communication flow path is opened when the pressure of liquid in the supply flow path is less than or equal to the first depressurization threshold.

12. The droplet ejection device according to claim 11, wherein the supply side pressurization regulation valve comprises a differential pressure valve that closes the supply side pressurization communication flow path when a difference between the pressure of liquid in the supply flow path and atmospheric pressure is greater than the first depressurization threshold, and opens the supply side pressurization communication flow path when the difference between the pressure of liquid in the supply flow path and atmospheric pressure is less than or equal to the first depressurization threshold.

13. The droplet ejection device according to claim 6, further comprising a drainage flow path depressurizer that depressurizes the pressure of liquid in the drainage flow path if the pressure of liquid in the drainage flow path rises to greater than or equal to a second pressurization threshold which is specified in advance for the drainage flow path.

14. The droplet ejection device according to claim 6, wherein the pressure of liquid in the drainage flow path is depressurized using suction force of the supply pump if the pressure of liquid in the drainage flow path rises to greater than or equal to a second pressurization threshold which is specified in advance for the drainage flow path.

15. The droplet ejection device according to claim 14, further comprising:

a drainage side depressurization communication flow path that is in fluid communication with a liquid suction side of the supply pump and the drainage flow path; and a drainage side depressurization regulation valve that is provided on the drainage side depressurization communication flow path such that the drainage side depressurization communication flow path is closed when the pressure of liquid in the drainage flow path is less than the second pressurization threshold and the drainage side depressurization communication flow path is opened when the pressure of liquid in the drainage flow path is greater than or equal to the second pressurization threshold.

16. The droplet ejection device according to claim 15, wherein the drainage side depressurization regulation valve comprises a differential pressure valve that closes the drainage side depressurization communication flow path when a difference between the pressure of liquid in the drainage flow path and atmospheric pressure is less than the second pressurization threshold, and opens the drainage side depressurization communication flow path when the difference between the pressure of liquid in the drainage flow path and atmospheric pressure is greater than or equal to the second pressurization threshold.

17. A droplet ejection device comprising:

a head that ejects a liquid charged therein;

a supply flow path that supplies the liquid to the head and for which a first depressurization threshold is specified in advance;

a drainage flow path that drains the liquid charged into the head and for which a second depressurization threshold is specified in advance;

a supply pump that sucks the liquid, pressurizes the sucked liquid and supplies the sucked liquid to the head via the supply flow path, and that keeps a pressure of liquid in the supply flow path near to a predetermined supply flow path target pressure;

a drainage pump that sucks and drains the liquid via the drainage flow path, and that keeps a pressure of liquid in the drainage flow path near to a predetermined drainage flow path target pressure; and a pressurizer that, if the pressure of liquid in one or both of the supply flow path and the drainage flow path falls to less than or equal to the depressurization threshold specified in advance for that flow path, pressurizes the pressure of liquid in the flow path in which the pressure has fallen to less than or equal to the depressurization threshold.

18. The droplet ejection device according to claim 17, wherein a first pressurization threshold is specified in advance for the supply flow path and a second pressurization threshold is specified in advance for the drainage flow path, and the droplet ejection device further includes a depressurizer that, if the pressure of liquid in one or both of the supply flow path and the drainage flow path rises to greater than or equal to the pressurization threshold specified in advance for that flow path, depressurizes the pressure of liquid in the flow path in which the pressure has risen to greater than or equal to the pressurization threshold.

19. The droplet ejection device according to claim 17, wherein a first pressurization threshold is specified in advance for the supply flow path and a second pressurization threshold is specified in advance for the drainage flow path, and if the pressure of liquid in one or both of the supply flow path and the drainage flow path rises to greater than or equal to the pressurization threshold specified in advance for that flow path, the pressure of liquid in the flow path in which the pressure has risen to greater than or equal to the pressurization threshold is depressurized using suction force of the supply pump.

20. The droplet ejection device according to claim 19, further comprising:

a depressurization communication flow path that is in fluid communication with a liquid suction side of the supply pump and one or both of the supply flow path and the drainage flow path; and a depressurization regulation valve that is provided on the depressurization communication flow path such that, when the pressure of liquid in the flow path with which the depressurization communication flow path is in fluid communication is less than the pressurization threshold specified in advance for that flow path, the depressurization communication flow path is closed such that suction force of the supply pump is not propagated into the flow path in which the pressure of liquid is less than the pressurization threshold, and when the pressure of liquid in the flow path with which the depressurization communication flow path is in fluid communication is greater than or equal to the pressurization threshold specified in advance for that flow path, the depressurization communication flow path is opened such that suction force of the supply pump is propagated into the flow path in which the pressure of liquid is greater than or equal to the pressurization threshold for that flow path.

21. The droplet ejection device according to claim 20, wherein the depressurization regulation valve is a differential pressure valve that, when a difference between the pressure of liquid in the flow path with which the depressurization communication flow path is in fluid communication and atmospheric pressure is less than the pressurization threshold specified in advance for that flow path, closes the depressurization communication flow path such that suction force of the supply pump is not propagated into the flow path in which the difference between the pressure of liquid and atmospheric pressure is less than the pressurization threshold, and when the difference between the pressure of liquid in the flow path with which the depressurization communication flow path is in fluid communication and atmospheric pressure is greater than or equal to the pressurization threshold specified in advance for that flow path, opens the depressurization communication flow path such that suction force of the supply pump is propagated into the flow path in which the difference between the pressure of liquid and atmospheric pressure is greater than or equal to the pressurization threshold.

22. The droplet ejection device according to claim 17, wherein the drainage pump functions as the pressurizer that, if the pressure of liquid in one or both of the supply flow path and the drainage flow path falls to less than or equal to the depressurization threshold specified in advance for that flow path, pressurizes the pressure of liquid in the flow path in which the pressure has fallen to less than or equal to the depressurization threshold, using drainage force.

23. The droplet ejection device according to claim 22, further comprising:

a pressurization communication flow path that is in fluid communication with a liquid drainage side of the drainage pump and one or both of the supply flow path and the drainage flow path; and a pressurization regulation valve that is provided on the pressurization communication flow path such that, when the pressure of liquid in the flow path with which the pressurization communication flow path is in fluid communication is greater than the depressurization threshold specified in advance for that flow path, the pressurization communication flow path is closed such that drainage force of the drainage pump is not propagated into the flow path in which the pressure of liquid is greater than the depressurization threshold, and when the pressure of liquid in the flow path with which the pressurization communication flow path is in fluid communication is less than or equal to the depressurization threshold specified in advance for that flow path, the pressurization communication flow path is opened such that drainage force of the drainage pump is propagated into the flow path in which the pressure of liquid is less than or equal to the depressurization threshold.

24. The droplet ejection device according to claim 23, wherein the pressurization regulation valve is a differential pressure valve that, when a difference between the pressure of liquid in the flow path with which the pressurization communication flow path is in fluid communication and atmospheric pressure is greater than the depressurization threshold specified in advance for that flow path, closes the pressurization communication flow path such that drainage force of the drainage pump is not propagated into the flow path in which the difference between the pressure of liquid and atmospheric pressure is greater than the depressurization threshold, and when the difference between the pressure of liquid in the flow path with which the pressurization communication flow path is in fluid communication and atmospheric pressure is less than or equal to the depressurization threshold specified in advance for that flow path, opens the pressurization communication flow path such that drainage force of the drainage pump is propagated into the flow path in which the difference between the pressure of liquid and atmospheric pressure is less than or equal to the depressurization threshold.

* * * * *